US007931574B2

(12) United States Patent
Bracci

(10) Patent No.: US 7,931,574 B2
(45) Date of Patent: Apr. 26, 2011

(54) APPARATUS FOR AUTONOMOUSLY PERFORMING PHYSIOTHERAPIC EXERCISES

(75) Inventor: Marco Bracci, Capannoli (IT)

(73) Assignee: Donati, S.R.L., Vicopisano (IT)

( * ) Notice: Subject to any disclaimer, the term of this patent is extended or adjusted under 35 U.S.C. 154(b) by 0 days.

(21) Appl. No.: 12/600,906

(22) PCT Filed: May 26, 2008

(86) PCT No.: PCT/IB2008/052067

§ 371 (c)(1),
(2), (4) Date: Nov. 19, 2009

(87) PCT Pub. No.: WO2008/146238

PCT Pub. Date: Dec. 4, 2008

(65) Prior Publication Data

US 2010/0160127 A1 Jun. 24, 2010

(30) Foreign Application Priority Data

May 28, 2007 (IT) ..... PI2007A0063

(51) Int. Cl.
*A63B 26/00* (2006.01)

(52) U.S. Cl. ..... 482/143

(58) Field of Classification Search ..... 482/142–144, 482/139, 79, 148, 901; 602/32–35; 601/19, 601/23–34; D21/662; 606/237, 240–245
See application file for complete search history.

(56) References Cited

U.S. PATENT DOCUMENTS

| | | | | |
|---|---|---|---|---|
| 3,880,150 | A | 4/1975 | Vileikis | |
| 4,512,572 | A | 4/1985 | Hamm | |
| 4,602,619 | A * | 7/1986 | Wolf et al. | 606/241 |
| 5,308,359 | A * | 5/1994 | Lossing | 606/242 |
| 6,443,916 | B1 * | 9/2002 | Ilan | 601/26 |
| 6,692,451 | B2 * | 2/2004 | Splane, Jr. | 601/5 |
| 6,986,181 | B2 * | 1/2006 | Murphy et al. | 5/648 |
| 7,157,936 | B2 * | 1/2007 | Chauhan et al. | 326/41 |
| 2003/0154550 | A1 | 8/2003 | Murphy et al. | |

FOREIGN PATENT DOCUMENTS

| | | |
|---|---|---|
| DE | 3638359 | 9/1988 |
| DE | 3638359 A1 * | 9/1988 |
| DE | 19750751 | 2/1992 |
| DE | 19608524 | 4/1997 |
| DE | 20000847 | 5/2001 |
| WO | WO0151000 | 10/2001 |
| WO | WO2006103063 | 10/2006 |

OTHER PUBLICATIONS

English Abstract of DE19608524.
English Abstract of DE19750751.
English Abstract of DE20000847.
English Abstract of DE3638359.

* cited by examiner

*Primary Examiner* — Lori Baker
(74) *Attorney, Agent, or Firm* — Preston Smirman; Smirman IP Law, PLLC

(57) ABSTRACT

An apparatus for performing lumbar stretching treatments comprises a supporting structure where at least one electric motor vertically moves leg supporting members. A person that needs performing lumbar stretching treatments takes the right position at the apparatus and autonomously controls it powering the vertical movement of the leg supporting means which put into traction the lower section of the person's back. The apparatus may also be installed on specific beds having a lay surface horizontally translatable in order to improve the comfortable use of the apparatus.

25 Claims, 3 Drawing Sheets

APPARATUS FOR AUTONOMOUSLY PERFORMING PHYSIOTHERAPIC EXERCISES

CROSS-REFERENCE TO RELATED APPLICATION

The instant application is a national phase of International patent application number PCT/IB2008/052067, filed May 26, 2008, which claims priority to IT PI2007A000063, filed May 28, 2007, the entire specifications of all of which are expressly incorporated herein by reference.

FIELD OF THE INVENTION

The present invention concerns an apparatus for physiotherapy and postural education/reducation.

In particular the invention concerns an apparatus for performing passive lumbar stretching exercises.

DESCRIPTION OF THE PRIOR ART

Many pathologies causing more or less severe and/or chronic lumbar pain are often treated by physiokinesis therapy together with other specific therapies.

Strongly recommended treatments provide assuming analgetic postures able to decompress the lumbar intervertebral disks.

There are two main types of apparatus or physiotherapy devices specifically designed to perform such kind of treatments.

A first type consists of beds provided with belts or other means able to restrain on one side the upper part of the body and on the other side the legs laying on the bed, the bed being able to stretch the lumbar vertebras by gradually moving away the upper and lower sections of the bed itself.

In this way is obtained a passive stretching of the lumbar disks that maintained for some minutes and regularly repeated produces beneficial effects in many pathologies causing lumbar pain.

Nevertheless the use of such type of beds is not always recommended: in fact, many pathologies have to be treated by assuming analgetic postures with flexion. That is the case, for instance, of many lumbar stenosis, which require treatments in which the passive stretching of the intervertebral disks is associated with a reduction of the lumbar lordosis.

The apparatus known in the prior art which is able to carry on in the best way that function is the one known with the name of "analgetic lumbar positioner" that allows the decompression of the disks reducing at the same time the lumbar stenosis.

The "analgetic lumbar positioner is a device substantially consisting of a vertical column rested to a base and comprising leg supporting members apt to restrain the lower part of the legs in a horizontal position at a height from the ground which can be adjusted by turning a handle mounted on top of the column and acting upon a rack. In order to perform the treatment the patient is requested to laid down close to the "analgetic lumbar positioner", to bend its legs at an angle of 90° with respect to its body and to put the lower section of the legs on the leg supporting members of the apparatus. Once fastened the lower section of the legs the handle is turned to move up the leg supporting members until the lumbar section of the patient's back moves away from the ground of few centimeters as a result of the traction of the legs. The traction phase may lasts some minutes after that the trainer goes back to the patient and turns the handle in the opposite direction in order to move down the leg supporting members. The treatment may be repeated several times and, obviously frequent treatment sessions can be performed.

Such apparatus is, in the prior art, the one normally known and used in the medic and physiotherapy sector in order to perform the above described treatments.

Unfortunately the "analgetic lumbar positioner" has a limit in the fact that the treatment cannot be autonomously performed by the patient since the manual driving of the handle moving the leg supporting members implies the presence of a physiotherapist or another person in order to assist the patient during the treatment.

Such limit, that is the need of a continuous assistance during the treatment, is certainly responsible for the lack of popularity of an apparatus which is particularly efficient for performing the specific kind of treatment for which it is designed.

It is so clear how important is to look for solutions allowing the autonomous execution of treatments providing passive intervertebral disks decompression with reduction of the lumbar stenosis, without the need of external assistance.

SUMMARY OF THE INVENTION

Aim of this invention is to propose a high efficient apparatus for performing passive lumbar stretching, which can be used both in physiotherapy or gym centres and in private houses.

further aim of the invention is to propose an "analgetic lumbar positioner" with improved structure, enabling a completely autonomous execution of treatments providing passive intervertebral disks decompression with reduction of the lumbar stenosis.

Such aims are attained through an apparatus for performing passive lumbar stretching treatments, the apparatus comprising at least a supporting structure where leg supporting members can move in a substantially vertical direction, said leg supporting members being apt to support the lower section of a person's legs, the movement of said leg supporting members being obtained thanks to effecting means which can be controlled by the person that is under treatment at the apparatus.

Advantageously said leg supporting members move along said supporting structure in a direction which is inclined of about 10° with respect of a vertical line.

The supporting structure is advantageously provided with at least a base and at least a substantially vertical column.

According to a preferred embodiment the supporting structure is bound at a longitudinal end of a bed comprising a frame and a lay surface supporting the body of the person under treatment, said lay surface being able to horizontally, longitudinally translate with respect to said frame.

The horizontal translation is obtained thanks to the fact that the frame of the bed is provided with one or more longitudinal guides along which move wheels integral to the bottom of the lay surface.

Alternatively, according to a preferred embodiment, a lay surface supporting the person's back is hinged to the base, said lay surface being rotatable from a position in which it is substantially horizontal to a closed position in which it is substantially vertical, so minimizing the overall dimensions of the apparatus.

Advantageously, near the end where it is hinged, said lay surface provides revolving members freely rotating around an horizontal axis, said revolving members being arranged and sized so that when the lay surface is in the horizontal position said revolving members don not touch the ground, whilst, when the lay surface is in the vertical position, said revolving members touch the ground and the base is supported by said revolving members.

Advantageously the leg supporting members move along the supporting structure thanks to at least one vertical worm screw integral to the supporting structure and turned by an electric motor, said worm screw being coupled with a nut integral to the leg supporting members.

Alternatively the leg supporting members vertically move along the supporting structure thanks to at least one linear actuator or a pneumatic or hydraulic cylinder acting between the supporting structure and the leg supporting members.

Advantageously the effecting means vertically moving the leg supporting members are controlled by switch means arranged in a position easily reachable by the person under treatment.

Advantageously the leg supporting members comprise at least a member for supporting the lower section of the legs between the calf and the internal part of the knee and members supporting and restraining the ankles.

Advantageously the apparatus comprises an electronic unit apt to control the effecting means moving the leg supporting members, said electronic unit being able to acquire and store end positions of said leg supporting members and/or other working parameters of said effecting means.

From the above described characteristics are clear the advantages related to the use of an apparatus for performing passive lumbar stretching treatments according to the invention which allows the completely autonomous execution of physiotherapy treatments specifically intended to decompress the lumbar/sacral section of the vertebras, whose efficiency is scientifically demonstrated. The fact that the apparatus can be used by a person on his own renders it recommended not only in physiotherapy centres but also in private houses.

BRIEF DESCRIPTION OF THE DRAWINGS

However, for a better understanding of the above-mentioned advantages and characteristics of the present invention, this will now be described by way of embodiment examples, with reference to the accompanying drawings, in which.

DESCRIPTION OF PREFERRED EMBODIMENTS

Figure 1:
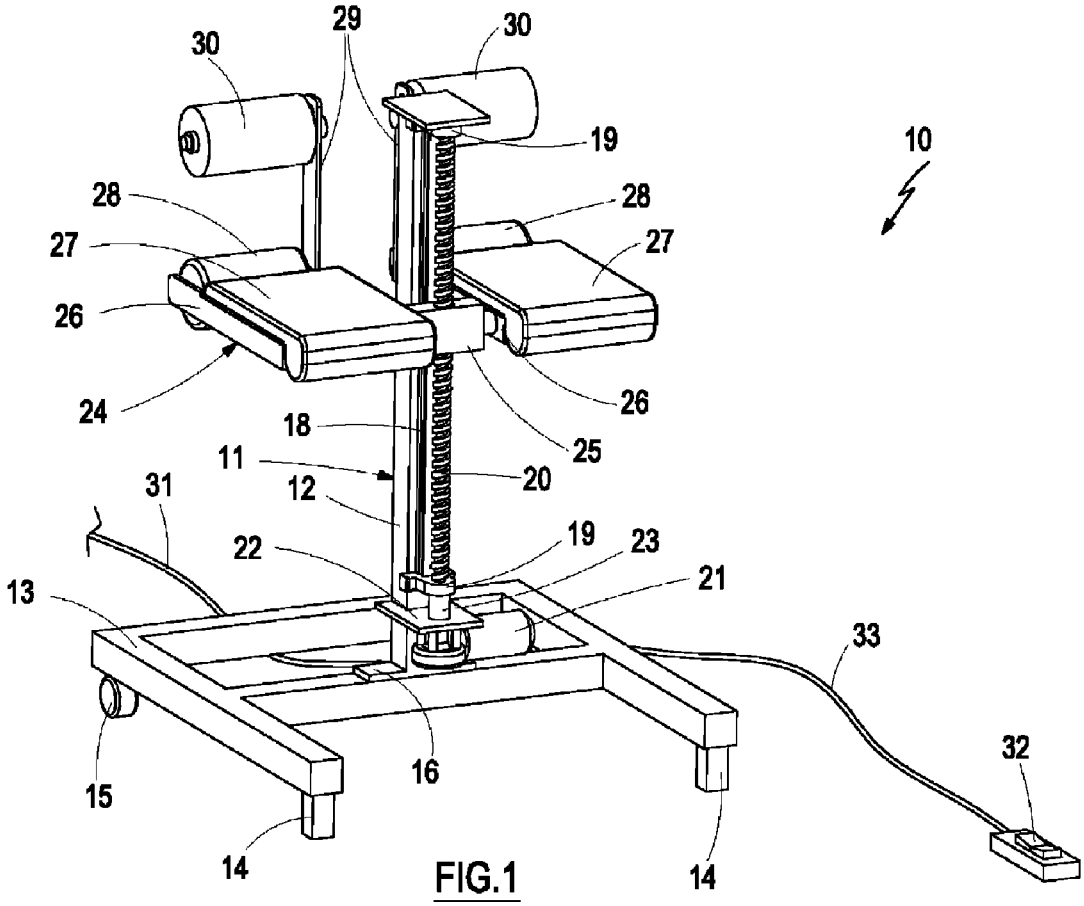
FIG. 1 shows a perspective view of an apparatus for performing lumbar stretching treatments according to the invention.

Referring to FIG. 1, it is labelled, as a whole, with 10, an apparatus for performing passive lumbar stretching treatments comprising a supporting structure, 11, comprising a vertical column, 12, and a base, 13, provided with foots, 14, and wheels, 15, apt to stabilize the position of the apparatus on the ground and to allow its easy transfer.

Through the end section, 16, the column 12 is firmly bound to the base 13 by welding, even if it could bound in a detachable way through screw means.

A vertical guide member, 18, is integral to the column, and at the ends of said guide, still integral to the column, there are clamp means, 19, provided with a hole, where are housed, and supported by radial bearings, the ends of a worm screw, 20.

At the lower end of the worm screw 20 is mounted a gear motor, 21, bound to a plate, 22, integral to the column 12. Between the plate 22 and the clamp 19 there is a thrust bearing, 23, transferring the force acting upon the worm screw to the plate 22. The output rod of the gear motor 21 is coaxial to the worm screw 20 and is connected to it so that it put into rotation the worm screw when it is powered.

The rotation of the worm screw causes the vertical movement of leg supporting members, 24, thanks to the fact that these lasts comprise a prismatic element, 25, provided with a hole where is housed a nut coupled with the worm screw 20, and it is also provided with a sliding element, not showed as it is of known technique, coupled with the guide 18.

At the sides of the prismatic element 25 are fixed supporting frames, 26, provided with upholstered means, 27, where rest the calfs of the person under treatment and further upholstered rollers, 28, supporting the lower section of the ankles. The upholstered means 27 are longitudinally movable along the frame 26 so that the leg supporting member is made suitable to people of any height. Rods, 29, bound to the end of the frames 26 mount further upholstered rollers, 30, adjustable in height thanks to longitudinal grooves made in the rods 29, said rollers 30 being apt to keep in touch with the upper part of the ankles in order to restrain them.

The gear motor 21 can be fed by rechargeable batteries integral to the apparatus or by means of the standard power supply network through a supply cable, 31, and/or possible power suppliers or transformers. The gear motor can be controlled by switch means, 32, which can be kept in hand by the person under treatment thanks to the presence of a connecting cable, 33.

Figure 2:
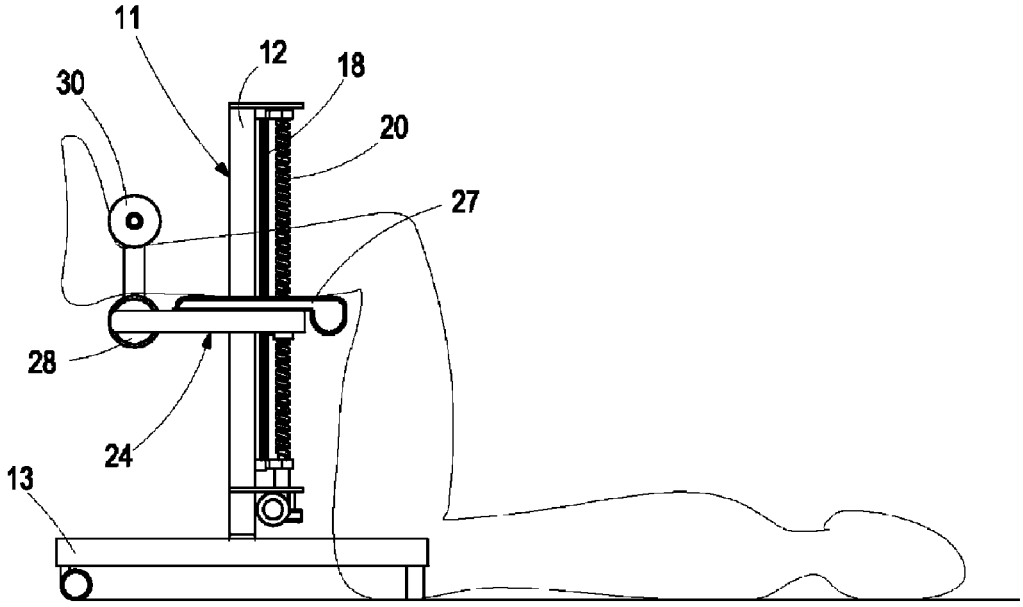
FIG. 2 shows a side view of the apparatus of FIG. 1 in a specific working configuration.
Figure 3:
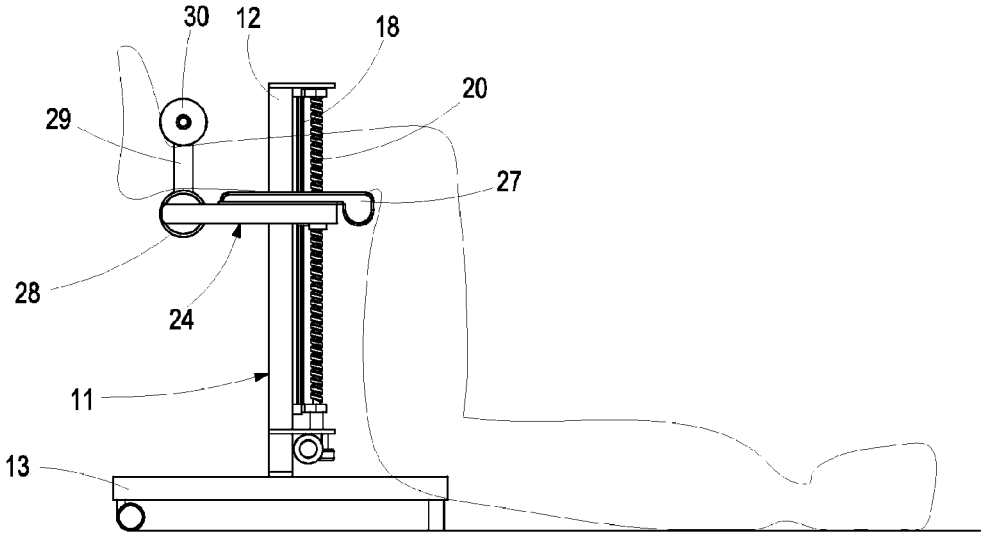
FIG. 3 shows a side view of the apparatus of FIG. 1 in a different working configuration.

As shown in FIGS. 2 and 3 the way of using the apparatus is extremely simple.

The person requiring treatments for the passive decompression of the intervertebral disks with reduction of lumbar stenosis lays on his back close to the apparatus and keeping his legs at angle of about 90° with respect to his body rests his legs on the upholstered means 27 of the leg supporting members 24. After inserting the ankles between the lower rollers 28 and the upper rollers 30, the legs are restrained and the person is ready to begin the treatment.

Pressing the three positions switch 32 the person power on the gear motor 21 which, thanks to the above described mechanism, move the leg supporting member 24 upwards along the column 12. The lower section of the legs raises so causing moving away the pelvis from the ground and putting under traction the lumbar vertebras. Arrived in the position of FIG. 3 the button of the switch 32 is released, the apparatus stops and the reached position is maintained.

You can notice that thanks to the fact that the leg supporting members can be automatically lowered until they are close to the ground, it is possible to take the right initial position at the apparatus even with the legs almost completely extended, letting the apparatus move up the legs. That is particularly useful and advantageous when the lumbar pain is particularly acute during flexion movements.

Once passed the amount of time required by the treatment, or when the person wishes to interrupt it, he needs just press the switch 32 in the opposite position in order to move down the leg supporting members 24 to the configuration of FIG. 2 thanks to the reverse side rotation of the gear motor 21.

Obviously, many changes may be carried out, still keeping safe the advantages and the characteristics of the apparatus for performing passive lumbar stretching treatments above described.

Figure 4:
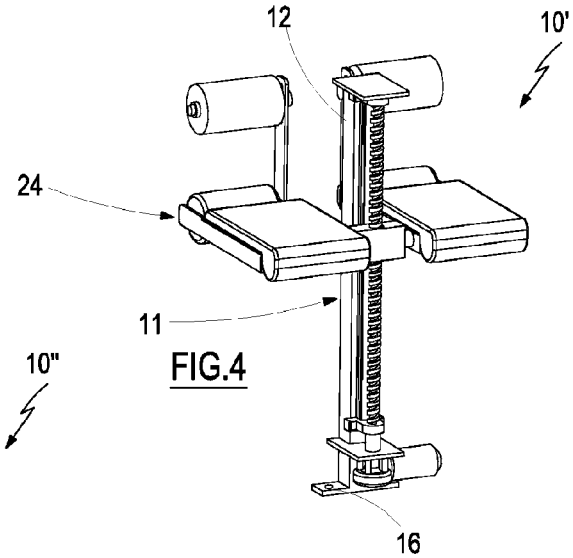
FIG. 4 shows a perspective view of a different embodiment of an apparatus for performing lumbar stretching treatments according to the invention.

In FIG. 4, for instance, is shown an embodiment of the invention in which the apparatus 10' has no base 13. By the end section 16 and suitable screw means the apparatus can be anywhere fastened, that is directly to the ground or to many types of medic beds normally on the market.

Figure 5:
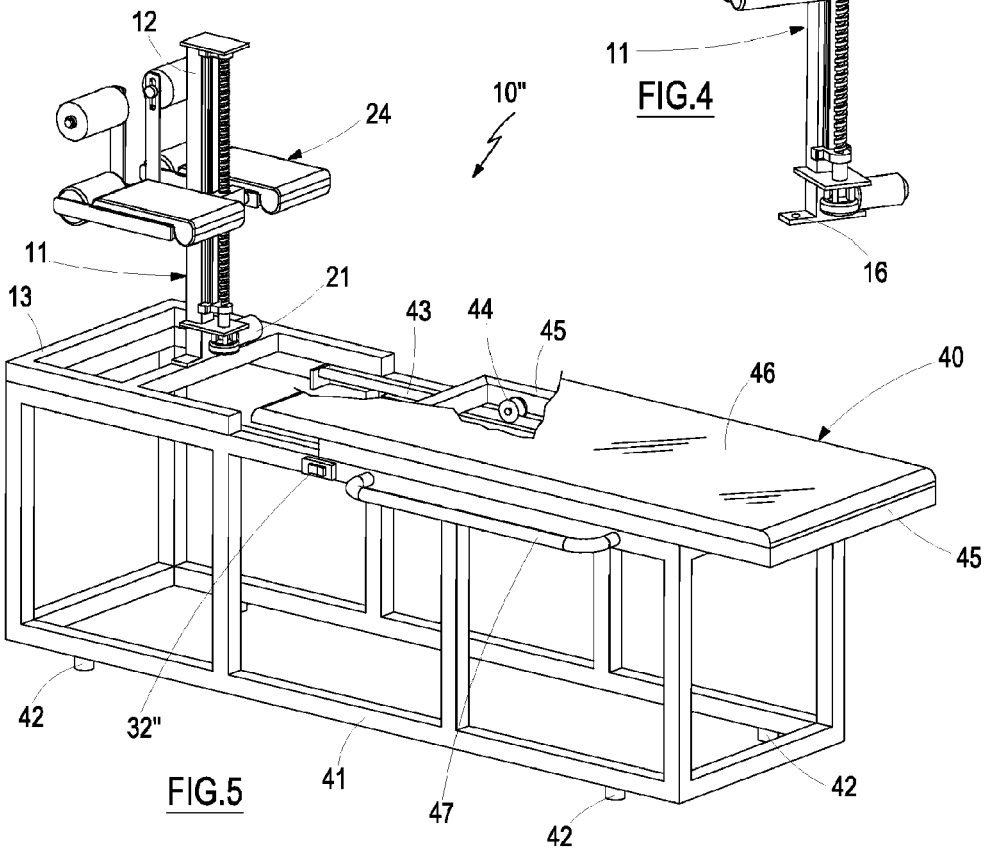
FIG. 5 shows a further embodiment, in partial section, of an apparatus according to the invention.

In fact, in FIG. 5 is shown a further embodiment of the invention in which the apparatus 10" is integral to a special bed, 40.

The bed has a frame, 41, provided with foots, 42, on the frame being fastened the base 13. The frame 41 is also provided with longitudinal guides, 43, where move wheels, 44, integral to a second frame, 45, of an upholstered lay surface, 46.

Thanks to the guides 43 and the wheels 44 the lay surface is able to longitudinally translate, obviously in a range determined by end elements, in order to render more comfortable the access to the apparatus.

The presence of the translatable lay surface is particularly suitable when accessing the apparatus with the leg supporting members completely lowered and then with the legs almost completely extended; in fact when the leg supporting members 24 are moving upwards the lay surface 46 get closer to the column 12 so favouring the natural movement of the legs.

On one side of the frame 41, in a easy to reach position there is the switch 32".

Handles 47, also bound to the frame 41, are comprised in the apparatus 10".

Figure 6:
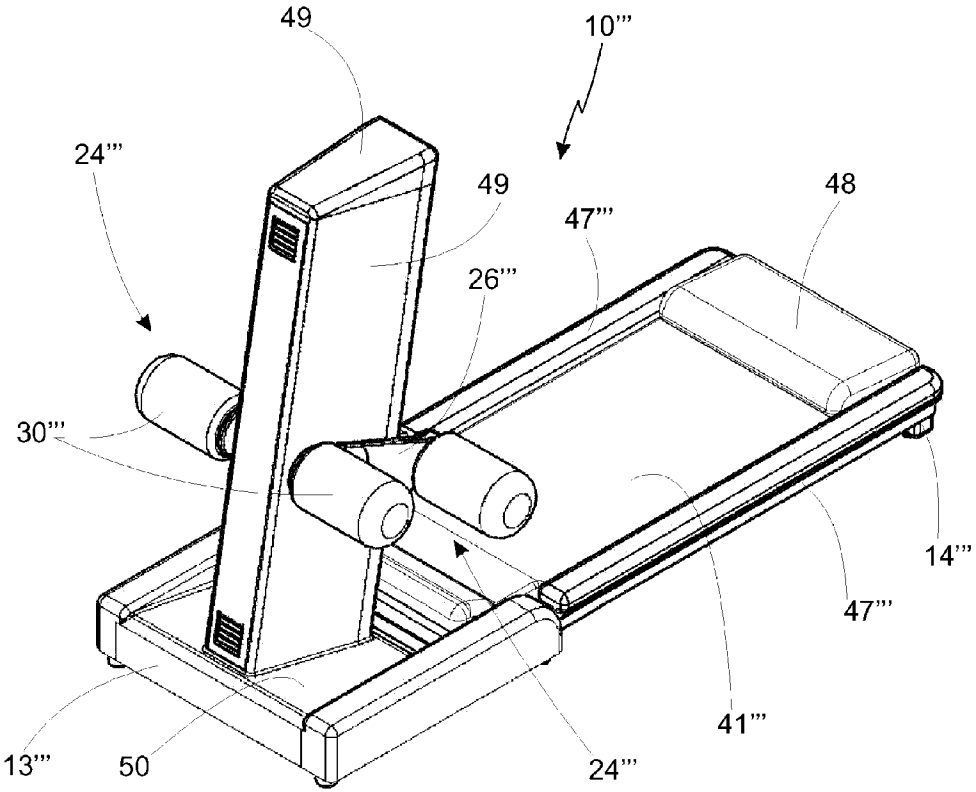
FIG. 6 shows a perspective view of a further embodiment of an apparatus according to the invention.

Another embodiment of the apparatus of the invention is labelled with 10''' in FIG. 6. In this embodiment a parson's back lay surface, 41''', is hinged at one end to the base 13'''. The lay surface 41''' is provided with a cushion, 48, foots, 14''', and lateral handles 47'''.

The column 12''', provided with carters, 49, protecting the various electro-mechanical parts, is bound to the base 13''', through a plane, 50, inclined of about 10° with respect to an horizontal plane, so that the leg supporting members, 24''', move along a line inclined of about 10° with respect to a vertical axis. Thanks to such little inclination during the lifting of the person's legs, the upper section of the legs is carried in a substantially vertical position without the need of translating the person's back towards the column 12''', so further increasing the comfortableness of the apparatus.

The frames 26''' are inclined with respect to an horizontal plane, the upholstered members 27 are replaced with upholstered rollers 27''', and the lower upholstered rollers 28 are not present. In that way the lower part of the legs rests on the rollers 27''', acting between the calf and the internal section of the knee, while the upholstered rollers 30''' contrast, pressing against the upper section of the ankle, the aptitude to rotate of the knee's articulation which would take place during the upwards movement of the leg supporting members 24'''.

Figure 7:
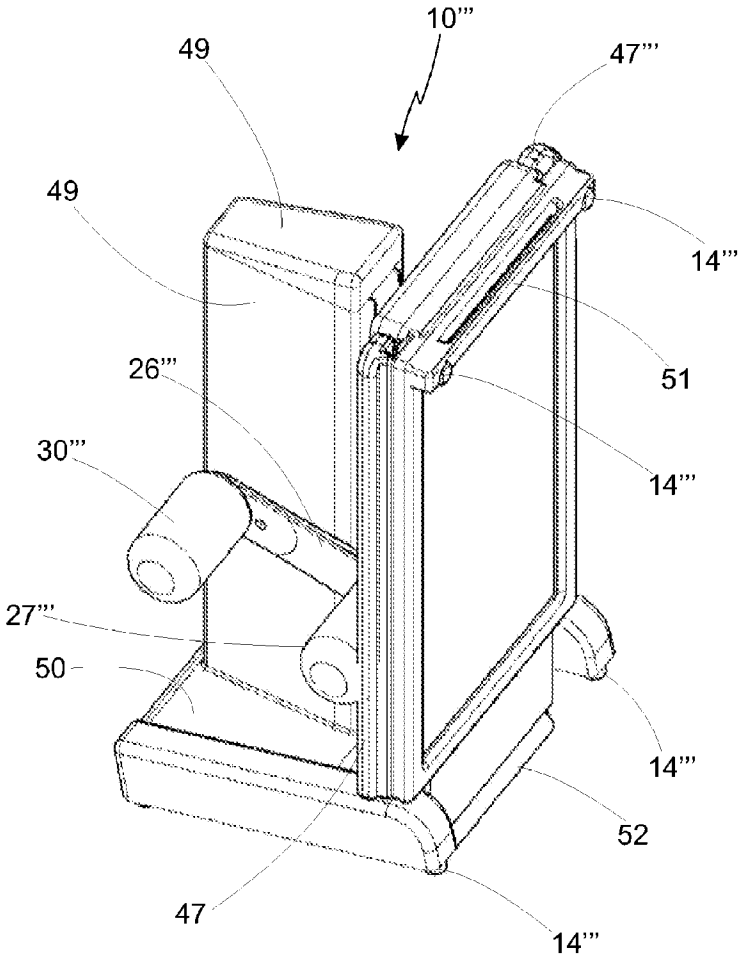
FIG. 7 shows a perspective view of the apparatus of FIG. 6 in a different working configuration.

In FIG. 7 is shown the apparatus 10''' in a non-use configuration. The lay surface 41''' is rotated of about 90° through an handle, 51, that can be used also to unlock the lay surface from the in-use position of FIG. 6, and it is carried in a substantially vertical position where it is automatically locked thanks to proper means located, for instance, in correspondence to the hinged end of the lay surface. Such configuration renders minimum the overall dimensions on the ground of the apparatus and it is particularly suitable when the apparatus is not being used. Furthermore, during the rotation of the lay surface 41''', a roller, 52, integral to the lay surface itself and freely rotatable around its axis, is moved down towards the ground, enters in touch with the ground and move away from the ground the foots 14''' placed in correspondence to the same end of the base 13'''. When the apparatus 10''' has to be transferred to a different location it simply needs to handle it from the handle 51 and, inclining the base 13" to let it be supported only by the roller 52, to easily pull it that is subject only to the rolling friction of the roller 52.

Certainly many more changes may be carried out to the apparatus of the invention both at the simple versions of FIGS. 1 to 4 and to the more complete versions of FIGS. 5 to 7; in particular many parts may be replaced with parts having a similar function.

For instance the vertical movement of the leg supporting members 24 may be obtained through the gear motor 21 using different kinematic mechanisms which are apt to obtain substantially vertical movements of the leg supporting members 24. In different embodiments the movement could be obtained by linear actuators acting between the plate 22 and the prismatic element 25; even pneumatic or hydraulic cylinders could be used, changing, in this last option, the energy supply means. In any case the switch means 32 or 32" may be located on a remote control in order to render even more comfortable the use of the apparatus.

The supporting structure 11 could be different from the one described and disclosed in the appended figures, both as regards the base 13 and the column 12. This last, in particular, could also be made of two or more substantially vertical columns properly connected each other and to the base 13.

The column/s, could be shaped ad to directly act as a guide for the leg supporting members 24, so becoming unnecessary the guide 18.

The leg supporting members 24 could have a structure and could comprise parts even much different from the ones described, remaining the same the function of supporting and restraining the lower section of the legs and maintaining them in a substantially horizontal position. For instance, in cheaper versions of the apparatus, the upholstered means 27 could be replaced with bands horizontally stretched between the sides of the frame 26, while proper belts could replace the upholstered rollers 28 and 30.

The roller 47 of the embodiment of FIGS. 6 and 7 could be replaced by two or more wheels properly spaced.

The effecting means, no matter what kind of propulsive force they use and no matter the kinematic mechanism used, could be controlled and powered by an electronic unit.

Thanks to the adoption of the electronic the apparatus could be provided with many further functions such as the possibility of setting various end positions of the leg supporting members 24, or the possibility of setting their speed, or even the possibility of acquiring and/or storing anthropometric parameters of the user so that specific treatment programmes could be created.

These and more modifications may be carried out to the apparatus for performing passive lumbar stretching treatments according to the invention, anyway, within the ambit of protection of the following claims.

The invention claimed is:

1. An apparatus for performing passive lumbar stretching treatments, with flexion, upon a person's body, comprising:

at least one supporting structure that includes at least one base member and at least one substantially vertical column member operably associated with the base member; and at least one leg supporting member that can move in a substantially vertical direction relative to said supporting structure, said leg supporting member including a first member for supporting the lower section of the person's leg between the calf and the knee and a second member for restraining movement of the person's ankles so as to maintain the lower part of the person's legs substantially parallel to the person's body;

wherein said second member is selectively operable to abut against a front surface of the person's ankles;

wherein the movement of said leg supporting member is selectively operable to move the person's pelvis upwardly away from a substantially horizontal surface so as to put under traction the person's lumbar vertebras while maintaining an angle of about 90° between the person's body and an upper part of the person's legs and between the upper part and the lower part of the person's legs;

wherein the movement of said leg supporting member is selectively operable through a motor system that can be controlled by the person that is under treatment at the apparatus.

2. An apparatus according to claim 1, wherein said leg supporting member moves along said supporting structure in a direction that is inclined about 10° with respect to a vertical axis.

3. An apparatus according to claim 1, wherein said supporting structure is bound at a longitudinal end of a bed, wherein said bed includes a frame and a bed surface supporting the person's body, said bed surface being selectively operable to horizontally and/or longitudinally translate with respect to said frame.

4. An apparatus according to claim 3, wherein said frame includes at least one longitudinal guide along which moves a wheel integral to the bottom of the bed surface.

5. An apparatus according to claim 3, wherein said bed surface is hinged to said base member, said bed surface being rotatable from a first position in which it is substantially horizontal relative to said base member to a second position in which it is substantially vertical relative to said base member.

6. An apparatus according to claim 5, wherein said bed surface includes a revolving member freely rotating about a horizontal axis, said revolving member being arranged and sized so that when said bed surface is in the horizontal position, said revolving member does not touch the ground, and when said bed surface is in the vertical position, said revolving member touches the ground and said base member is supported by said revolving member.

7. An apparatus according to claim 1, wherein said supporting structure includes at least one guide along which moves a sliding member integral to said leg supporting member.

8. An apparatus according to claim 1, wherein said leg supporting member moves along said supporting structure through at least one vertical worm screw integral to said supporting structure and turned by an electric motor, said worm screw being coupled with a nut integral to said leg supporting member.

9. An apparatus according to claim 1, wherein said leg supporting member vertically moves along said supporting structure through to at least one linear actuator.

10. An apparatus according to claim 1, wherein said leg supporting member vertically moves along said supporting structure through at least one pneumatic or hydraulic cylinder acting between said supporting structure and said leg supporting member.

11. An apparatus according to claim 1, wherein said motor system is controlled by a switch arranged in a position substantially easily reachable by the person under treatment in the apparatus.

12. An apparatus according to claim 11, wherein said switch is housed in a remote control.

13. An apparatus according to claim 1, further comprising at least one electronic unit selectively operable to control said motor system.

14. An apparatus according to claim 13, wherein said electronic unit is selectively operable to acquire and/or store an end position of said leg supporting member and/or other working parameters of said motor system.

15. An apparatus for performing passive lumbar stretching treatments, with flexion, upon a person's body, comprising:

at least one supporting structure that includes at least one base member and at least one substantially vertical column member operably associated with the base member; and at least one leg supporting member that can move in a substantially vertical direction relative to said supporting structure, said leg supporting member including a first member for supporting the lower section of the person's leg between the calf and the knee and a second member for supporting and/or restraining the person's ankles so as to maintain the lower part of the person's legs substantially parallel to the person's body;

wherein the movement of said leg supporting member is selectively operable to move the person's pelvis upwardly away from a substantially horizontal surface so as to put under traction the person's lumbar vertebras while maintaining an angle of about 90° between the person's body and an upper part of the person's legs and between the upper part and the lower part of the person's legs;

wherein the movement of said leg supporting member is selectively operable through a motor system that can be controlled by the person that is under treatment at the apparatus;

wherein said supporting structure is bound at a longitudinal end of a bed, wherein said bed includes a frame and a bed surface supporting the person's body, said bed surface being selectively operable to horizontally and/or longitudinally translate with respect to said frame;

wherein said bed surface is hinged to said base member, said bed surface being rotatable from a first position in which it is substantially horizontal relative to said base member to a second position in which it is substantially vertical relative to said base member;

wherein said bed surface includes a revolving member freely rotating about a horizontal axis, said revolving member being arranged and sized so that when said bed surface is in the horizontal position, said revolving member does not touch the ground, and when said bed surface is in the vertical position, said revolving member touches the ground and said base member is supported by said revolving member.

16. An apparatus according to claim 15, wherein said leg supporting member moves along said supporting structure in a direction that is inclined about 10° with respect to a vertical axis.

17. An apparatus according to claim 15, wherein said frame includes at least one longitudinal guide along which moves a wheel integral to the bottom of the bed surface.

18. An apparatus according to claim 15, wherein said supporting structure includes at least one guide along which moves a sliding member integral to said leg supporting member.

19. An apparatus according to claim 15, wherein said leg supporting member moves along said supporting structure through at least one vertical worm screw integral to said supporting structure and turned by an electric motor, said worm screw being coupled with a nut integral to said leg supporting member.

20. An apparatus according to claim 15, wherein said leg supporting member vertically moves along said supporting structure through to at least one linear actuator.

21. An apparatus according to claim 15, wherein said leg supporting member vertically moves along said supporting structure through at least one pneumatic or hydraulic cylinder acting between said supporting structure and said leg supporting member.

22. An apparatus according to claim 15, wherein said motor system is controlled by a switch arranged in a position substantially easily reachable by the person under treatment in the apparatus.

23. An apparatus according to claim 22, wherein said switch is housed in a remote control.

24. An apparatus according to claim 15, further comprising at least one electronic unit selectively operable to control said motor system.

25. An apparatus according to claim 24, wherein said electronic unit is selectively operable to acquire and/or store an end position of said leg supporting member and/or other working parameters of said motor system.

* * * * *